US005452991A

United States Patent [19]

Kita et al.

[11] Patent Number: 5,452,991

[45] Date of Patent: Sep. 26, 1995

[54] HERMETIC COMPRESSOR WITH PRESSURE PULSATION REDUCING MECHANISM FOR REFRIGERANT

[75] Inventors: Ichiro Kita, Nara; Junichiro Yabiki, Fujisawa, both of Japan

[73] Assignee: Matsushita Refrigeration Company, Osaka, Japan

[21] Appl. No.: 245,135

[22] Filed: May 17, 1994

[30] Foreign Application Priority Data

May 20, 1993 [JP] Japan ..... 5-118203

[51] Int. Cl.[6] ..... F04B 53/00

[52] U.S. Cl. ..... 417/312; 181/403

[58] Field of Search ..... 417/312, 902; 181/403, 229, 224, 249

[56] References Cited

U.S. PATENT DOCUMENTS

| | | | |
|---|---|---|---|
| 2,147,311 | 2/1939 | Nash | 181/403 |
| 3,125,182 | 3/1964 | Earley | 181/403 |
| 3,279,683 | 10/1966 | Kleinlein | 417/312 |
| 3,486,687 | 12/1969 | Ayling | 417/312 |
| 3,857,652 | 12/1974 | Thayer | 417/312 |
| 4,330,239 | 5/1982 | Gannaway | 417/312 |
| 4,371,319 | 2/1983 | Murayama et al. | 417/312 |
| 4,784,583 | 11/1988 | Bar | 417/312 |
| 5,164,552 | 11/1992 | Pandeya et al. | 181/403 |
| 5,173,034 | 12/1992 | Riffe | 417/312 |
| 5,205,719 | 4/1993 | Childs et al. | 417/312 |

FOREIGN PATENT DOCUMENTS

| | | | |
|---|---|---|---|
| 4171278 | 6/1992 | Japan . | |
| 1239376 | 6/1986 | U.S.S.R. | 417/312 |

*Primary Examiner*—Richard A. Bertsch
*Assistant Examiner*—Peter Korytnyk
*Attorney, Agent, or Firm*—Lowe, Price, LeBlanc & Becker

[57] ABSTRACT

A hermetic compressor includes a sealed casing which accommodates therein a compressing unit for compressing a refrigerant and a driving unit for driving the compressing unit. A communication passage is provided for establishing communication between the compressing unit and a discharge muffler. The discharge muffler is formed therein with a substantially annular hermetic passage for the compressed refrigerant introduced via the communication passage. In the substantially annular hermetic passage, the introduced compressed refrigerant is bifurcated in opposite directions. The substantially annular hermetic passage has an outlet in the discharge muffler. At the outlet, the bifurcated refrigerant joins and flows out of the substantially annular hermetic passage so as to reduce pressure pulsation of the compressed refrigerant by canceling pressure pulsation components contained in the bifurcated refrigerant. In order to enhance the cancellation effect, the outlet may be arranged at a position which is opposite, in a diametrical direction, to a position where the substantially annular hermetic passage communicates with the communication passage.

10 Claims, 7 Drawing Sheets

HERMETIC COMPRESSOR WITH PRESSURE PULSATION REDUCING MECHANISM FOR REFRIGERANT

BACKGROUND OF THE INVENTION

1. Field of the Invention

The present invention relates to a hermetic compressor for use in, such as, a refrigerator and an air conditioner.

2. Description of the Prior Art

Recently, hermetic compressors of reduced size and with reduced vibration and noise have been largely demanded in refrigerators, air conditioners and the like irrespective of their types.

One of the typical conventional hermetic compressors is disclosed, such as, in Japanese Unexamined Patent Publication No. 4-171278, which will be briefly discussed with reference to FIGS. 9 and 10.

FIG. 9 shows a horizontal cross-sectional view of the conventional hermetic compressor with components in a sealed casing being illustrated in a top plan view, along with a schematic diagram of other components of the entire refrigeration system. FIG. 10 shows a partly-sectioned enlarged view of a portion A identified by a circle in FIG. 9. In FIG. 9, the hermetic compressor 1, along with a condenser 15, an evaporator 16 and an expansion valve 17, forms the refrigeration system 18 in which a refrigerant 12 is hermetically enclosed for-circulation therethrough. The hermetic compressor 1 includes the sealed casing 14 which accommodates therein a driving unit 19 in the form of an electric motor having a stator and a rotor, and a compressing unit 20 having a cylinder 24 and a piston 25 received in the cylinder 24. The driving unit 19, when energized, causes a reciprocating motion of the piston 25 in the cylinder 24 via a crankshaft and a connecting rod. The sealed casing 14 further accommodates therein an induction pipe 21, a discharge pipe 22, an induction muffler 23 and a discharge muffler 26. In FIG. 10, numeral 28 denotes a compression chamber in the cylinder 24, which communicates with the interior of the discharge muffler 26 via a discharge chamber 27 formed in a cylinder head and a communication passage 29 having a downstream end or an outlet 30 which is opened to the interior of the discharge muffler 26. The communication passage 29 is formed in a base block having the cylinder 24 therein.

Now, the operation of the conventional hermetic compressor 1 as structured above will be described hereinbelow.

When the driving unit 19 is energized, the rotor of the driving unit 19 starts to rotate so that the piston 25 starts a reciprocating motion via the crankshaft and the connecting rod. Accordingly, the refrigerant 12 circulated from the evaporator 16 and introduced into the sealed casing 14 via the induction pipe 21 is further sucked into the compression chamber 28 of the cylinder 24 via the induction muffler 23. The sucked refrigerant 12 is compressed in the compression chamber 28 during the compression stroke of the piston 25 so as to be introduced into the interior space of the discharge muffler 26 from the outlet 30 via the discharge chamber 27 and the communication passage 29. Thereafter, the compressed refrigerant 12 is conducted to the exterior of the sealed casing 14 via the discharge pipe 22. Specifically, the compressed refrigerant 12 introduced to the exterior of the sealed casing 14 is conducted to the condenser 15 to be condensed and then to the expansion valve 17 for immediate expansion and further to the evaporator 16 where the cooling action is performed.

As appreciated, since the refrigerant is sucked into the compression chamber 28 during a half rotation of the crankshaft and compressed during a subsequent half rotation of the crankshaft, the pressure pulsation of the refrigerant is inevitably generated, which causes vibration and noise at the hermetic compressor 1 and further may vibrate the condenser 15, leading to the generation of vibration and noise at the entire refrigeration system 18.

In order to suppress the generation of such vibration and noise, the pressure pulsation of the refrigerant should be reduced in the hermetic compressor. However, the conventional hermetic compressor as described above can not effectively reduce such pressure pulsation.

SUMMARY OF THE INVENTION

Therefore, it is an object of the present invention to provide an improved hermetic compressor that can effectively reduce pressure pulsation of a refrigerant at a discharge muffler in the hermetic compressor.

According to one aspect of the present invention, a hermetic compressor comprises a sealed casing; compressing means, provided in the sealed casing, for compressing a refrigerant; driving means, provided in the sealed casing, for driving the compressing means; a communication passage provided in the sealed casing and having a first outlet, the communication passage communicating with the compressing means for conducting the compressed refrigerant to the first outlet; a discharge muffler provided in the sealed casing and having a substantially annular groove on an inner periphery thereof, the groove communicating with the first outlet within the groove; a muffler ring received in the discharge muffler so that the groove and an outer periphery of the muffler ring cooperatively form a substantially annular passage for the compressed refrigerant introduced via the first outlet, the substantially annular passage having a second outlet for conducting the compressed refrigerant introduced via the first outlet and flowing through the substantially annular passage to the exterior of the substantially annular passage; and a discharge passage communicating with the discharge muffler so as to discharge the compressed refrigerant conducted to the exterior of the substantially annular passage to the exterior of the sealed casing.

According to another aspect of the present invention, a hermetic compressor comprises a sealed casing; compressing means, provided in the sealed casing, for compressing a refrigerant; driving means, provided in the sealed casing, for driving the compressing means; a communication passage provided in the sealed casing and having a first-outlet, the communication passage communicating with the compressing means for conducting the compressed refrigerant to the first outlet; a discharge muffler provided in the sealed casing and having a substantially annular hermetic passage therein, the substantially annular hermetic passage communicating with the first outlet so as to bifurcate the compressed refrigerant introduced via the first outlet in opposite directions within the substantially annular hermetic passage, the substantially annular hermetic passage having in the discharge muffler a second outlet where the bifurcated refrigerant joins and flows out of the substantially annular hermetic passage; and a discharge passage communicating with the discharge muffler so as to discharge the compressed refrigerant flowing out of the substantially annular hermetic passage to the exterior of the sealed casing.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to limit the present invention.

In the drawings.

DESCRIPTION OF THE PREFERRED EMBODIMENT

Now, a preferred embodiment of the present invention will be described hereinbelow with reference to FIGS. 1 to 4. In these figures, where appropriate, those components or structures that are the same as or similar to those of the aforementioned prior art are assigned the same reference marks so as to omit detailed explanation thereof and of the corresponding operations in the following description for avoiding redundant disclosure.

Figure 1:
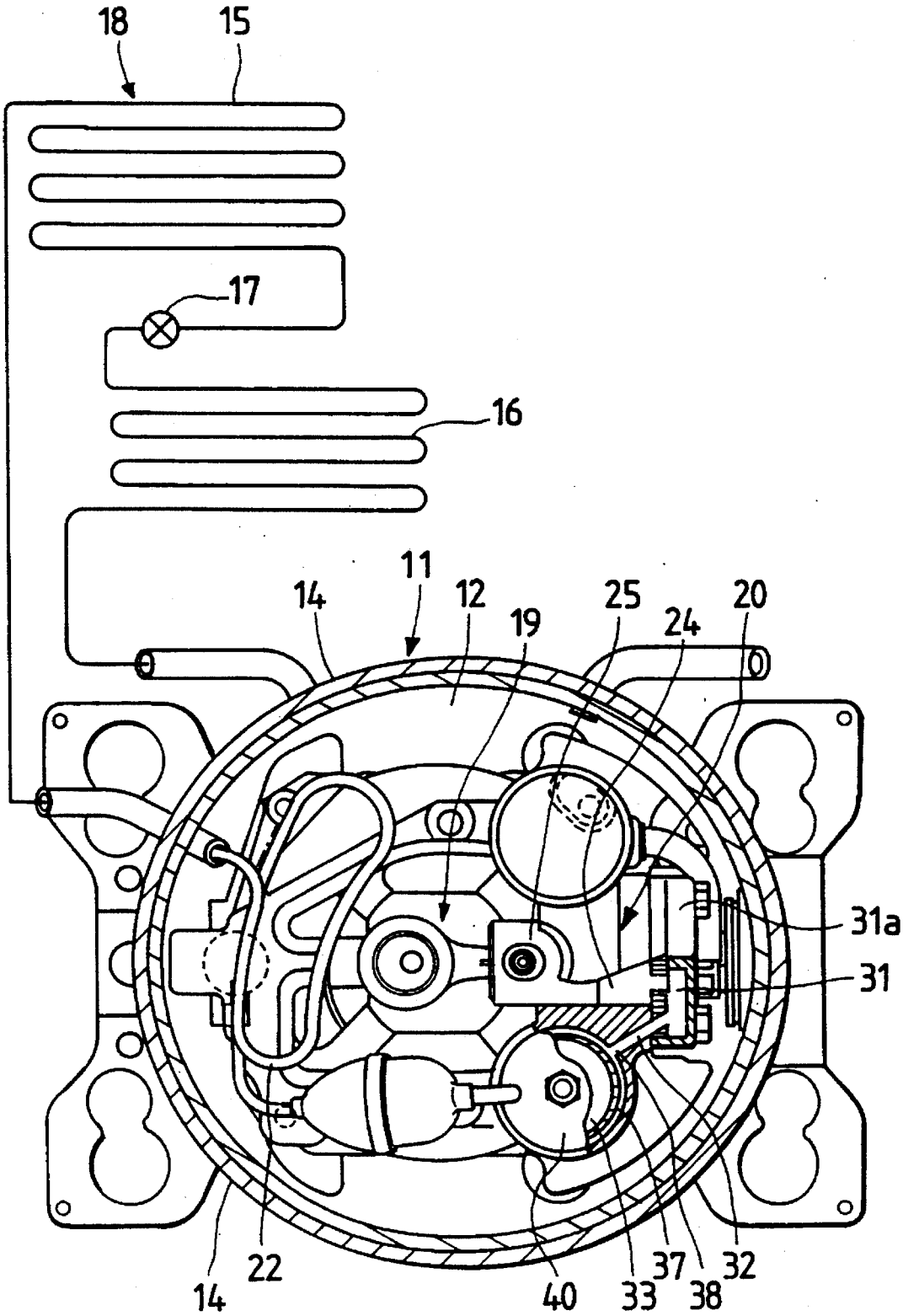
FIG. 1 is a horizontal cross-sectional view showing a hermetic compressor with components in a sealed casing of the compressor being illustrated in a pay-sectioned top plan view according to a preferred embodiment of the present invention, along with a schematic diagram showing other components of the entire refrigeration system.
Figure 2:
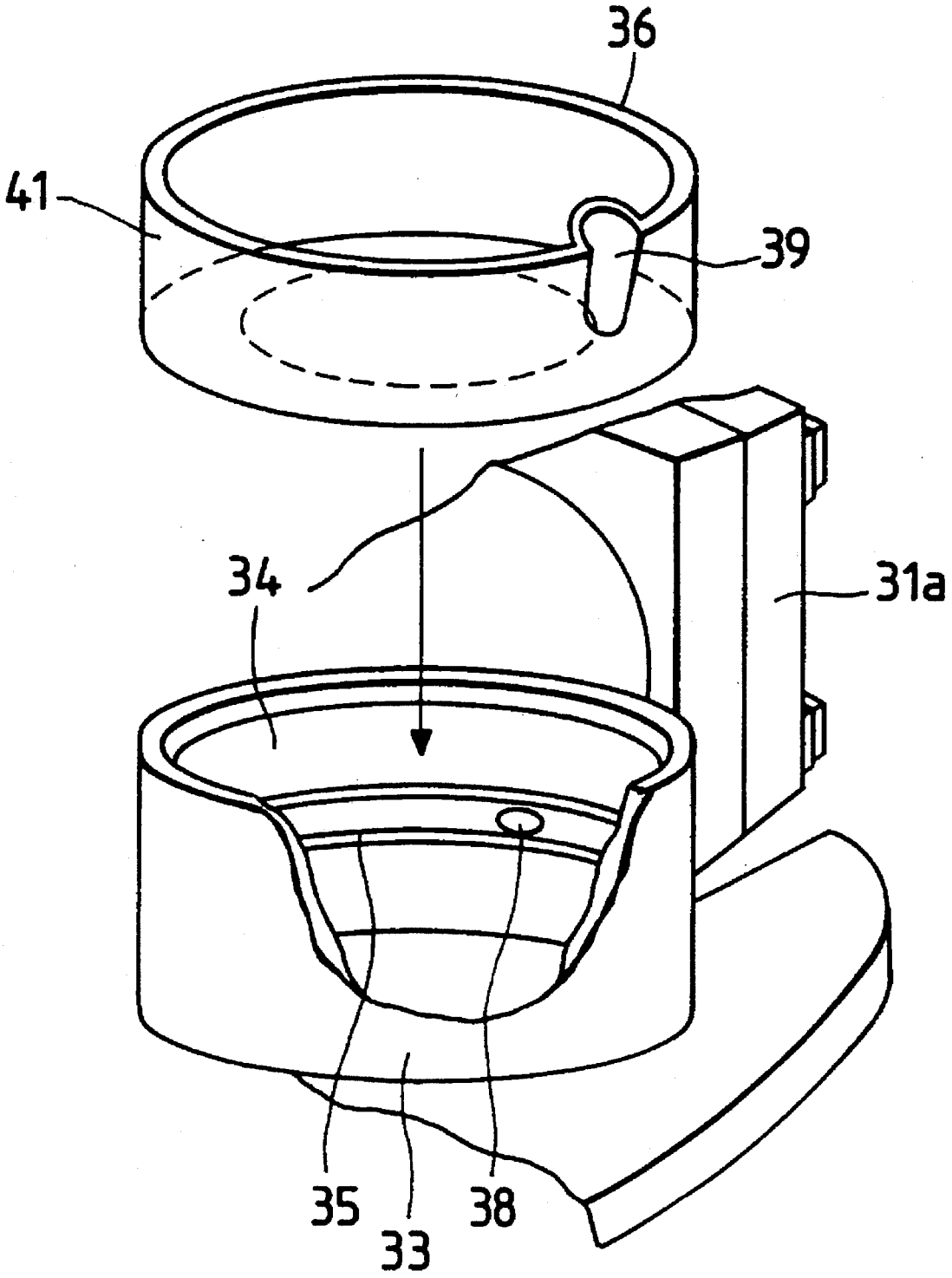
FIG. 2 is an exploded perspective view showing a disassembled state of an essential part of the hermetic compressor shown in FIG. 1.
Figure 3:
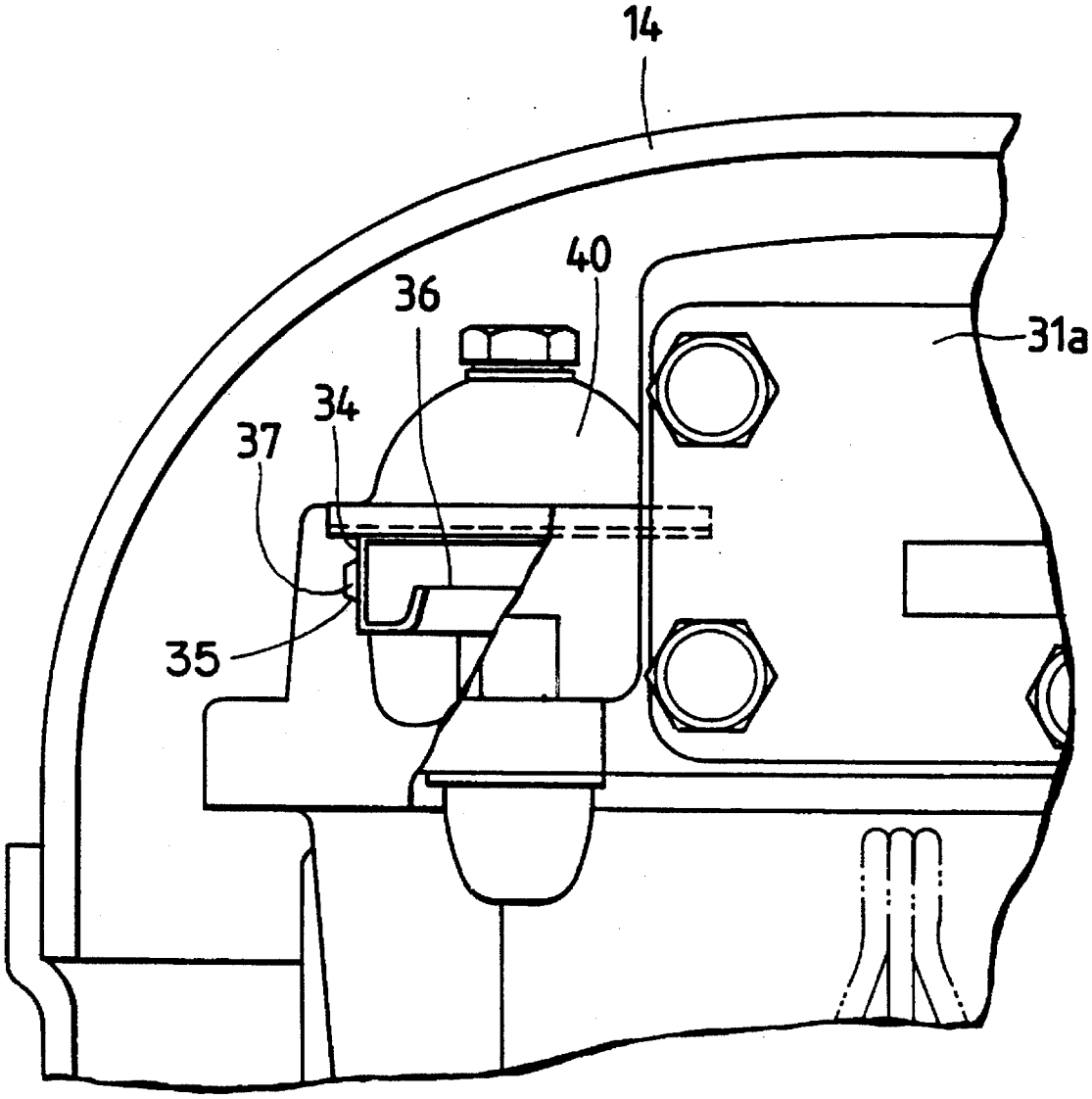
FIG. 3 is a diagram showing an essential part, partly sectioned, of the hermetic compressor shown in FIG. 1.
Figure 4:
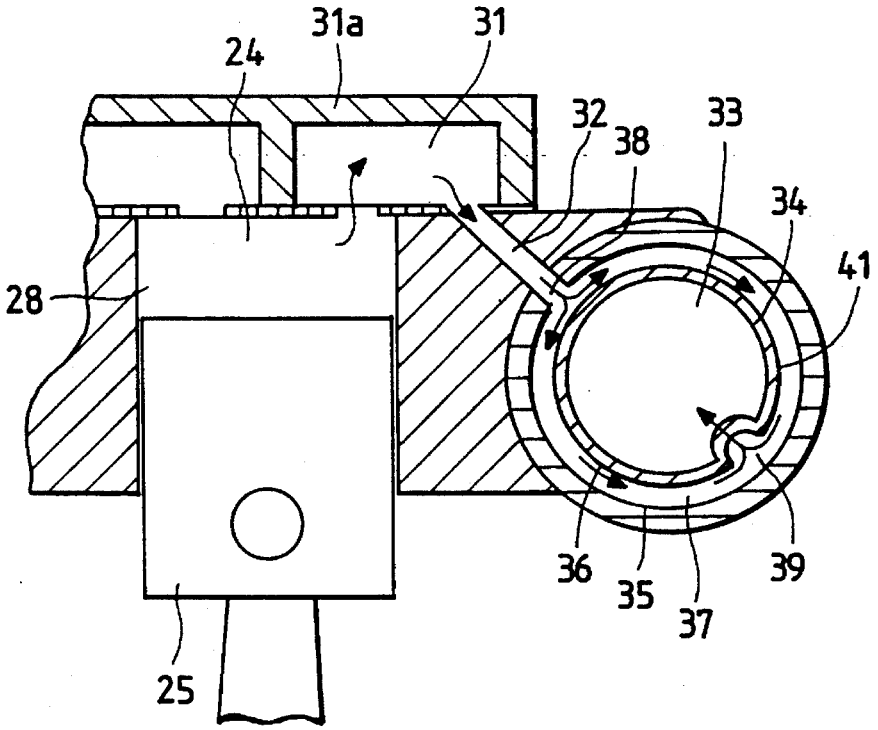
FIG. 4 is a sectional diagram for explaining an operation of an essential part of the hermetic compressor shown in FIG. 1.

FIG. 1 is a horizontal cross-sectional view showing a hermetic compressor 11 with components in the sealed casing 14 of the compressor being illustrated in a partly-sectioned top plan view, along with a schematic diagram showing other components of the entire refrigeration system 18. FIG. 2 is an exploded perspective view showing a disassembled state of an essential part of the hermetic compressor 11. FIG. 3 is a diagram showing an essential part, partly sectioned, of the hermetic compressor 11. FIG. 4 is a sectional diagram for explaining an operation of an essential part of the hermetic compressor 11.

In these figures, the interior of a discharge muffler 33 communicates with the compression chamber 28 in the cylinder 24 via a discharge chamber 31 formed in a cylinder head 31*a* and a communication passage 32 formed in the base block having the cylinder 24 therein. The communication passage 32 is opened to the interior of the discharge muffler 33 at an outlet 38 thereof. As best seen in FIGS. 2 and 3, an inner periphery 34 of a circumferential wall of the discharge muffler 33 has an annular recess in the form of a groove 35 which extends all along the circumference of the inner periphery 34. A muffler ring 36 generally of a cylindrical shape with a raised bottom and with an open upper end is press-fit in the discharge muffler 33. Specifically, the muffler ring 36 is press-fit in the discharge muffler 33 with an outer periphery 41 of a circumferential wall of the muffler ring 36 being in close contact with the inner periphery 34 of the discharge muffler 33 so that an annular passage 37 for the refrigerant is formed by cooperation and coaction between the groove 35 and the outer periphery 41 of the muffler ring 36. The refrigerant passage 37 is hermetically formed except at the outlet 38 of the communication passage 32 and an outlet 39 of the muffler ring 36. As best seen in FIG. 2, the outlet 38 of the communication passage 32 is in the form of an opening formed at a bottom of the groove 35 so as to open into the refrigerant passage 37. Further, the outlet 39 is in the form of a recess which is formed by indenting a portion of the circumferential wall of the muffler ring 36 inward. In this preferred embodiment, a depth of the outlet 39 becomes larger toward the open upper end of the muffler ring 36. In FIG. 3, numeral 40 denotes the interior space of the discharge muffler 33 above the muffler ring 36, which communicates with the discharge pipe 22.

Now, the operation of the hermetic compressor 11 as structured above will be described hereinbelow.

The refrigerant 12 sucked into the compression chamber 28 of the cylinder 24 is compressed by means of the reciprocating motion of the piston 25. As described before, due to the repetition of the sucking and compressing actions, the refrigerant 12 has the pressure pulsation corresponding to a rotational frequency of the rotor of the driving unit 19. The compressed refrigerant with the pressure pulsation is conducted from the compression chamber 28 to the refrigerant passage 37 at the outlet 38 via the discharge chamber 31 and the communication passage 32.

As shown in FIG. 4, the refrigerant 12 which reached the refrigerant passage 37 at the outlet 38 is bifurcated in two opposite circumferential directions. The pressure pulsation of the bifurcated refrigerant 12 is gradually reduced due to a resistance of the refrigerant passage 37 as the refrigerant advances in the refrigerant passage 37. The pressure pulsation of the refrigerant is further moderated when the divided refrigerant collides and joins with each other at the outlet 39 of the muffler ring 36 to cancel pressure pulsation components contained in the divided refrigerant mutually. The joined refrigerant 12 is then released into the interior space 40 of the discharge muffler 33 via the outlet 39 of the muffler ring 36.

As described above, the pressure pulsation of the refrigerant can be reduced notably by forming the refrigerant passage 37 in the discharge muffler 33. On the other hand, in order to further enhance the cancellation effect of the pressure pulsation components contained in the divided refrigerant, in this preferred embodiment, the outlet 39 of the muffler ring 36 is arranged at a position which is opposite to that of the outlet 38 of the communication passage 32 in a diametrical direction with respect to the center of the discharge muffler 33 or of the muffler ring 36 as shown in FIG. 4. In other words, the outlets 38 and 39 are arranged at positions on a line passing through the center of the discharge muffler 33 or of the muffler ring 36, which are opposite to each other with respect to the center of the discharge muffler 33 or of the muffler ring 36. By arranging the outlets 38 and 39 in such a positional relationship, circumferential lengths of the bifurcated passages in the refrigerant passage 37 from the outlet 38 to the outlet 39 are set equal to each other. Accordingly, the in-phase pressure pulsation components contained in the bifurcated refrigerant, which was simultaneously bifurcated at the outlet 38, collide with each other at the outlet 39 so that the foregoing cancellation effect can be further enhanced to further reduce the pressure pulsation of the refrigerant 12.

Figure 5:
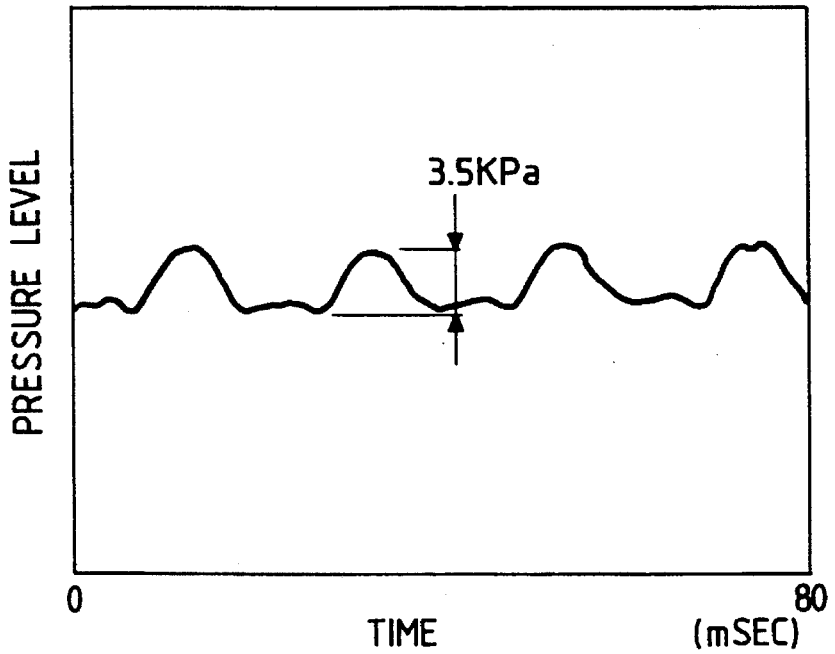
FIG. 5 is a time-domain graph of pressure pulsation of a refrigerant realized by the hermetic compressor shown in FIG. 1.
Figure 6:
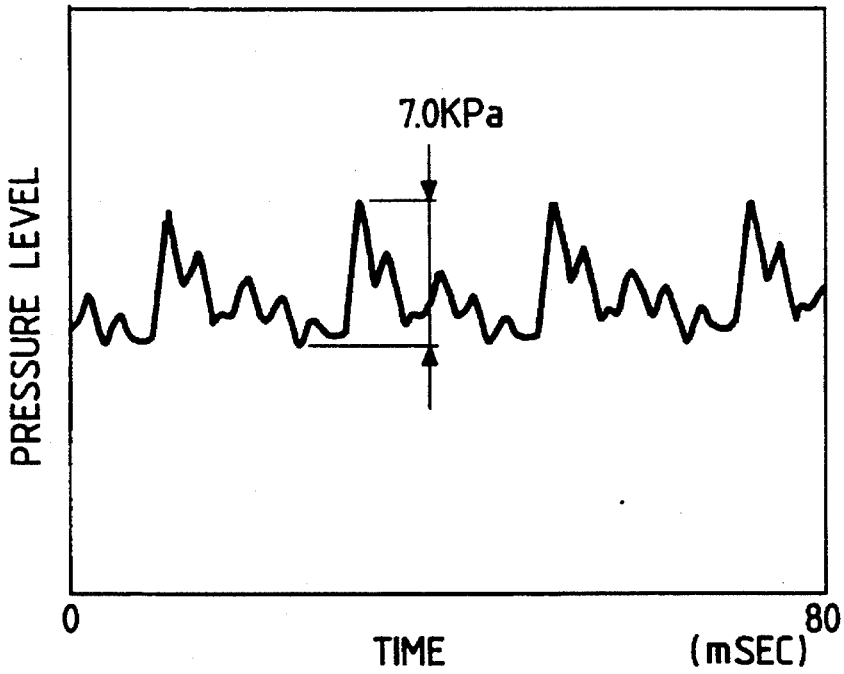
FIG. 6 is a time-domain graph of pressure pulsation of a refrigerant realized by a conventional hermetic compressor.

FIG. 5 shows a time-domain graph of the pressure pulsation of the refrigerant realized by the hermetic compressor 11 of this preferred embodiment, and FIG. 6 shows a time-domain graph of the pressure pulsation of the refrigerant realized by the foregoing conventional hermetic compressor 1.

As seen from these figures, the maximum pressure variation is reduced by half in the hermetic compressor 11 of this preferred embodiment as compared with the conventional hermetic compressor 1. Further, it is also seen that the pressure variations are smoothed on the whole in the hermetic compressor 11 of this preferred embodiment as compared with the conventional hermetic compressor 1. This means that a vibration exciting factor is effectively reduced in the hermetic compressor 11 of this preferred embodiment.

Figure 7:
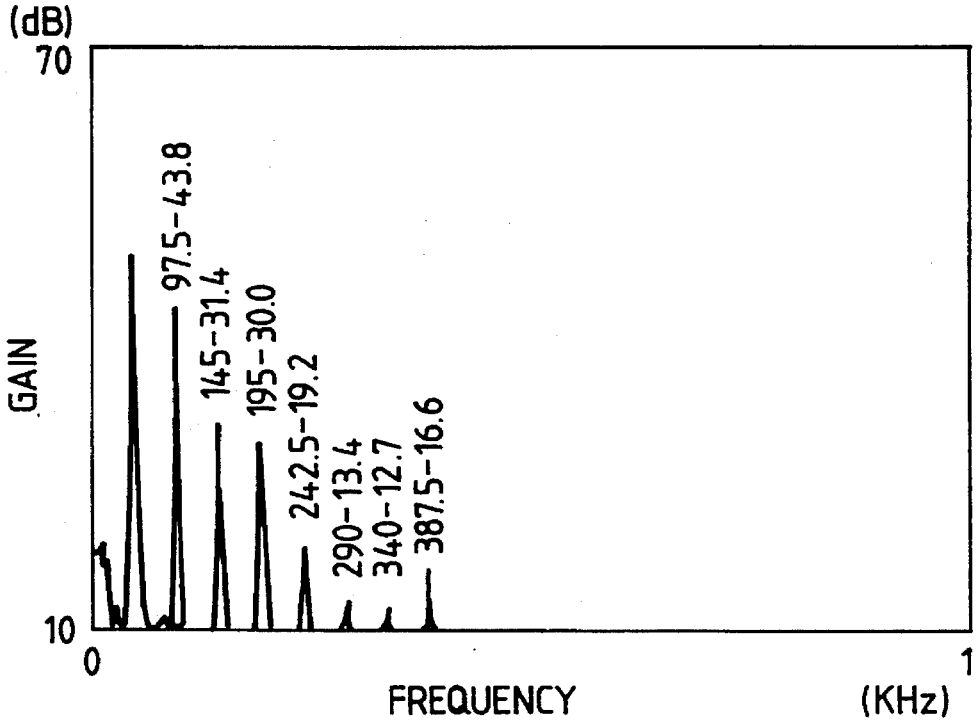
FIG. 7 is a graph showing a frequency characteristic of pressure pulsation components of the refrigerant in the hermetic compressor of FIG. 1.
Figure 8:
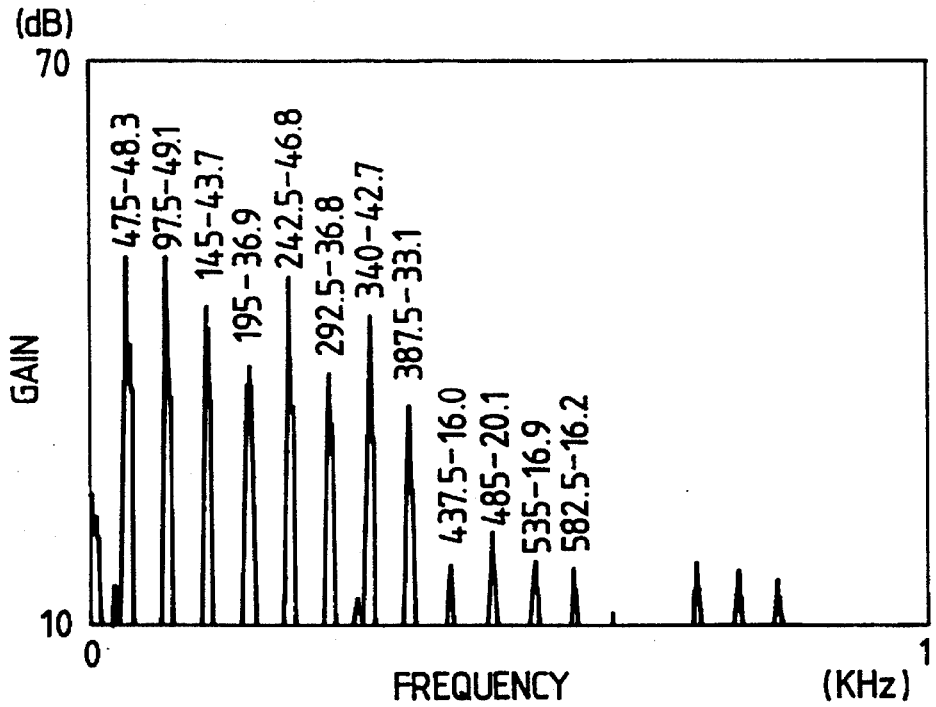
FIG. 8 is a graph showing a frequency characteristic of pressure pulsation components of the refrigerant in the conventional hermetic compressor.
Figure 10:
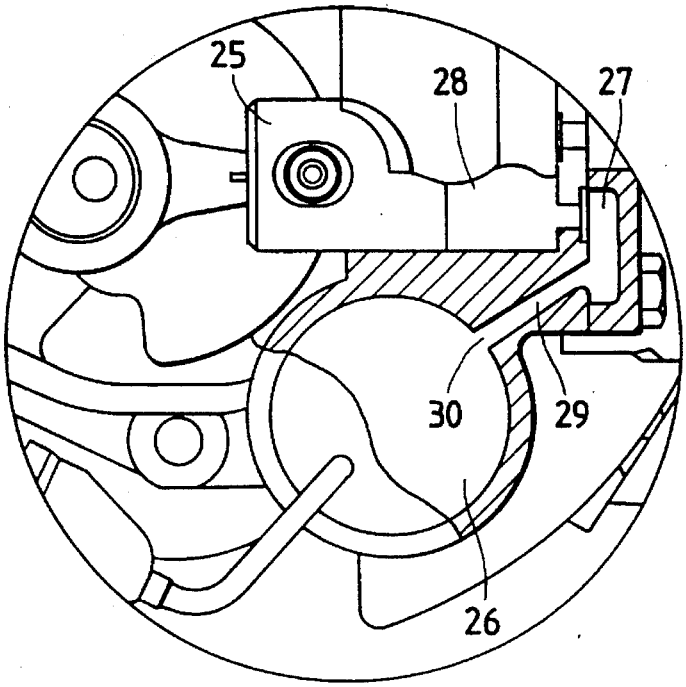
FIG. 10 PRIOR ART
FIG. 10 is a partly-sectioned enlarged view of a portion A identified by a circle in FIG. 9.
Figure 9:
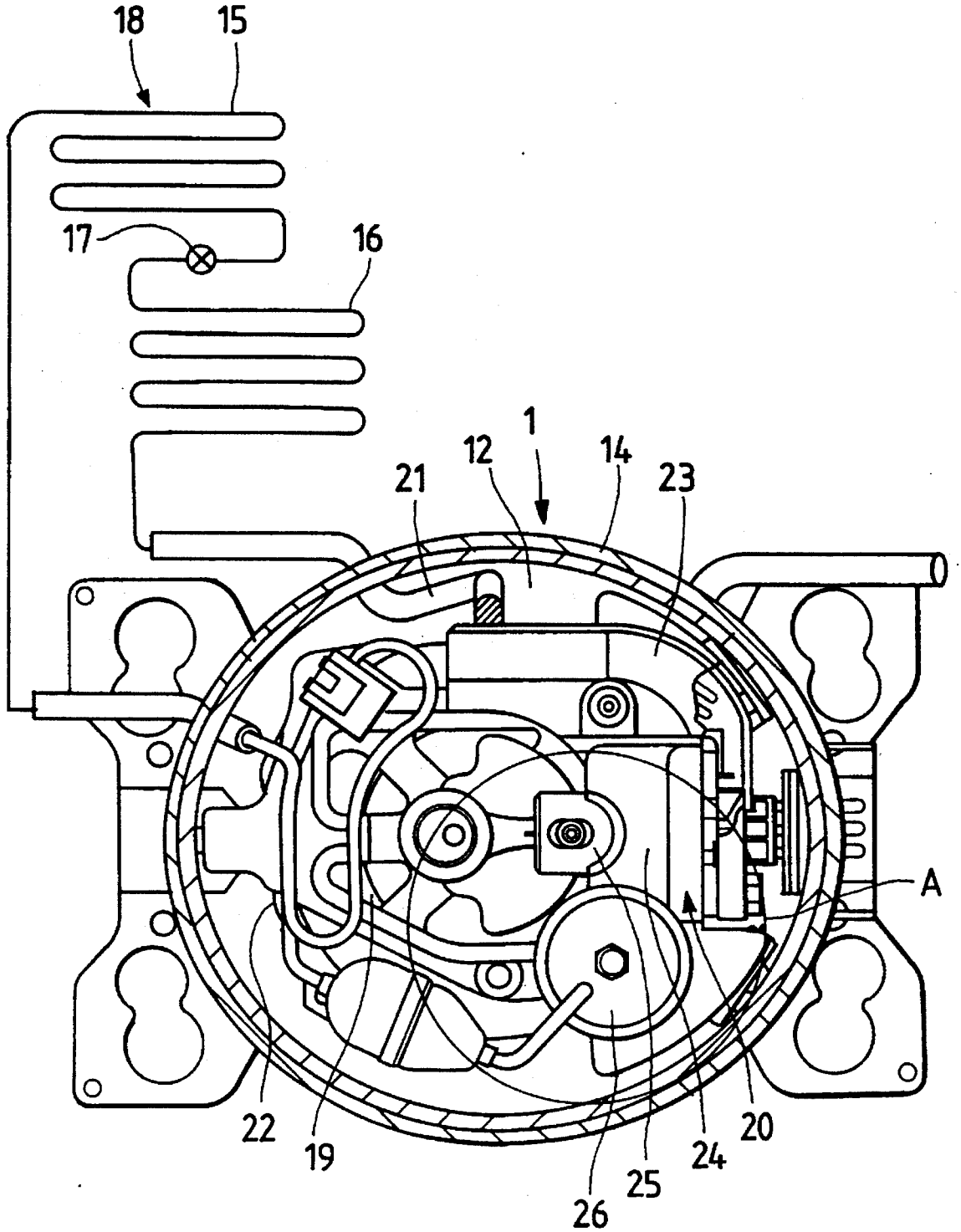
FIG. 9 PRIOR ART
FIG. 9 is a horizontal cross-sectional view showing the conventional hermetic compressor with components in a sealed casing being illustrated in a top plan view, along with a schematic diagram showing other components of the entire refrigeration system.

FIG. 7 is a graph showing a frequency characteristic of the pressure pulsation components of the refrigerant in the hermetic compressor 11 of this preferred embodiment, and FIG. 8 is a graph showing a frequency characteristic of the pressure pulsation components of the refrigerant in the conventional hermetic compressor 1.

As seen from these figures, the pressure pulsation components having peak values greater than 10 dB are reduced on the whole in the hermetic compressor 11 of this preferred embodiment as compared with the conventional hermetic compressor 1. It is also seen that the peak value of each of the pressure pulsation components is significantly reduced in the hermetic compressor 11 of this preferred embodiment. In FIGS. 7 and 8, "numeral-numeral" represents a relationship between a frequency and a gain. For example, "97.5–43.8" in FIG. 7 represents that a pressure pulsation component of a frequency of 97.5 Hz has a gain of 43.8 dB. As appreciated from these figures, in this preferred embodiment, specific noise (particularly low-frequency noise) of the refrigerant itself caused by the pressure pulsation is effectively reduced, and further, the generation of resonance of the discharge pipe 22 due to the pressure pulsation of the refrigerant is effectively prevented so that the vibration and noise which would be otherwise caused by such resonance can be notably suppressed. As a result, the hermetic compressor with reduced vibration and noise can be realized.

Further, since the refrigerant 12 with such an improved pressure pulsation characteristic is conducted to the condenser 15 of the refrigeration system 18, the generation of resonance of the piping of the condenser 15 is also effectively prevented so that the entire refrigeration system with reduced vibration and noise can be realized.

Although the annular refrigerant passage 37 is formed as being concentric with the discharge muffler 33 or the muffler ring 36 in the foregoing preferred embodiment, the refrigerant passage 37 may be formed as being eccentric in one particular direction to vary cross-sectional areas of the refrigerant passage 37 therealong so as to match a particular characteristic of the hermetic compressor.

Since the forming of the groove 35 as well as the assembling of the muffler ring 36 into the discharge muffler 33 can be performed by the simple operations, the hermetic compressor of the foregoing preferred embodiment is suitable for the mass production.

It is to be understood that this invention is not to be limited to the preferred embodiment and modifications described above, and that various changes and modifications may be made without departing from the spirit and scope of the invention as defined in the appended claims.

What is claimed is:

1. A hermetic compressor, comprising:

a sealed casing:

compressing means, provided in said sealed casing, for compressing a refrigerant;

driving means, provided in said sealed casing, for driving said compressing means;

a communication passage provided in said sealed casing and having a first outlet, said communication passage communicating with said compressing means for conducting the compressed refrigerant to said first outlet;

a discharge muffler provided in said sealed casing and having a substantially annular groove on an inner periphery thereof, said groove communicating with said first outlet within said groove;

a muffler ring received in said discharge muffler, said muffler ring having an outer periphery pressed against said inner periphery of the discharge muffler so that said groove and said outer periphery of said muffler ring cooperatively form a substantially annular passage for the compressed refrigerant introduced via said first outlet, said substantially annular passage having a second outlet for conducting the compressed refrigerant introduced via said first outlet and flowing through said substantially annular passage to the exterior of said substantially annular passage; and a discharge passage communicating with said discharge muffler so as to discharge the compressed refrigerant conducted to the exterior of said substantially annular passage to the exterior of said sealed casing.

2. A hermetic compressor, comprising:

a sealed casing;

compressing means, provided in said sealed casing, for compressing a refrigerant;

driving means, provided in said sealed casing, for driving said compressing means;

a communication passage provided in said sealed casing and having a first outlet, said communication passage communicating with said compressing means for conducting the compressed refrigerant to said first outlet;

a discharge muffler provided in said sealed casing and having a substantially annular groove on an inner periphery thereof, said groove communicating with said first outlet within said groove;

a muffler ring received in said discharge muffler so that said groove and an outer periphery of said muffler ring cooperatively form a substantially annular passage for the compressed refrigerant introduced via said first outlet, said substantially annular passage having a second outlet of conducting the compressed refrigerant introduced via said first outlet and flowing through said substantially annular passage to the exterior of said substantially annular passage; and a discharge passage communicating with said discharge muffler so as to discharge the compressed refrigerant conducted to the exterior of said substantially annular passage to the exterior of said sealed casing, wherein said second outlet is provided at a position which is opposite, in a diametrical direction, to a position where said groove communicates with said first outlet.

3. A hermetic compressor, comprising:

a sealed casing;

compression means, provided in said sealed casing, for compressing a refrigerant;

driving means, provided in said sealed casing, for driving said compressing means;

a communication passage provided in said sealed casing and having a first outlet, said communication passage communicating with said compressing means for conducting the compressed refrigerant to said first outlet.;

a discharge muffler provided in said sealed casing and having a substantially annular groove on an inner periphery thereof, said groove communicating with said first outlet within said groove;

a muffler ring received in said discharge muffler so that said groove and an outer periphery of said muffler ring cooperatively form a substantially annular passage for the compressed refrigerant introduced via said first outlet, said substantially annular passage having a second outlet for conducting the compressed refrigerant introduced via said first outlet and flowing through said substantially annular passage to the exterior of said substantially annular passage; and a discharge passage communicating with said discharge muffler so as to discharge the compressed refrigerant conducted to the exterior of said substantially annular passage to the exterior of said sealed casing, wherein said second outlet is provided at a position so that said substantially annular passage provides bifurcated passages having lengths equal to each other, each of said bifurcated passages extending from a position where said groove communicates with said first outlet, to the position of said second outlet.

4. A hermetic compressor, comprising:

a sealed casing;

compressing means, provided in said sealed casing, for compressing a refrigerant;

driving means, provided in said sealed casing, for driving said compressing means;

a communication passage provided in said sealed casing and having a first outlet, said communication passage communicating with said compressing means for conducting the compressed refrigerant to said first outlet;

a discharge muffler provided in said sealed casing and having a substantially annular groove on an inner periphery thereof, said groove communicating with said first outlet within said groove;

a muffler ring received in said discharge muffler so that said groove and an outer periphery of said muffler ring cooperatively form a substantially annular passage for the compressed refrigerant introduced via said first outlet, said substantially annular passage having a second outlet for conducting the compressed refrigerant introduced via said first outlet and flowing through said substantially annular passage to the exterior of said substantially annular passage; and a discharge passage communicating with said discharge muffler so as to discharge the compressed refrigerant conducted to the exterior of said substantially annular passage to the exterior of said sealed casing, wherein said first outlet is an opening formed in a wall defining said groove and said second outlet is formed by indenting a portion of a wall of said muffler ring so as to conduct the compressed refrigerant flowing through said substantially annular passage to an interior space of said discharge muffler.

5. A hermetic compressor, comprising:

a sealed casing;

compressing means, provided in said sealed casing, for compressing a refrigerant;

driving means, provided in said sealed casing, for driving said compressing means;

a communication passage provided in said sealed casing and having a first outlet, said communication passage communicating with said compressing means for conducting the compressed refrigerant to said first outlet;

a discharge muffler provided in said sealed casing and having a substantially annular hermetic passage therein, said substantially annular hermetic passage communicating with said first outlet so as to bifurcate the compressed refrigerant introduced via said first outlet in opposite directions within said substantially annular hermetic passage, said substantially annular hermetic passage having in said discharge muffler a second outlet where the bifurcated refrigerant joins and flows out of said substantially annular hermetic passage; and a discharge passage communicating with said discharge muffler so as to discharge the compressed refrigerant flowing out of said substantially annular hermetic passage to the exterior of said sealed casing, wherein said substantially annular hermetic passage is defined in part by a substantially annular groove formed on an inner periphery of said discharge muffler and an outer periphery of a muffler ring received in said discharge muffler, said outer periphery of the muffler ring being in close contact with said inner periphery of the discharge muffler to cooperate therewith to further define the substantially annular hermetic passage.

6. The hermetic compressor as set forth in claim 5, wherein:

said second outlet is provided at a position which is opposite, in a diametrical direction, to a position where said substantially annular hermetic passage communicates with said first outlet.

7. The hermetic compressor as set forth in claim 5, wherein:

said second outlet is provided at a position so that said substantially annular hermetic passage provides bifurcated passages having lengths equal to each other, each of said bifurcated passages extending from a position where said substantially annular hermetic passage communicates with said first outlet, to the position of said second outlet.

8. The hermetic compressor as set forth in claim 5, wherein:

said second outlet is formed by indenting a portion of a wall of said muffler ring.

9. The hermetic compressor as set forth in claim 5, wherein:

said first outlet is an opening formed in a wall defining said groove.

10. A hermetic compressor comprising:

a sealed casing;

compressing means, provided in said sealed casing, for compressing a refrigerant;

driving means, provided in said sealed casing, for driving said compressing means;

a communication passage provided in said sealed casing and having a first outlet, said communication passage communicating with said compressing means for conducting the compressed refrigerant to said first outlet;

a discharge muffler provided in said sealed casing and having a substantially annular groove on an inner periphery thereof, said groove communicating with said first outlet within said groove;

a muffler ring received in said discharge muffler so that said groove and an outer periphery of said muffler ring cooperatively form a substantially annular passage for bifurcating a flow of the compressed refrigerant introduced via said first outlet into two bifurcated flows which flow in opposite directions within said substantially annular passage, said substantially annular passage having a second outlet where the bifurcated refrigerant flows rejoin and flow out of said substantially annular passage; and a discharge passage communicating with said discharge muffler so as to discharge the rejoined refrigerant flow flowing out of said substantially annular passage to the exterior of said sealed casing.

* * * * *